United States Patent [19]

Park

[11] 4,314,405

[45] Feb. 9, 1982

[54] HAIR CUTTING DEVICE

[76] Inventor: Du P. Park, 3656 W. Montrose, Chicago, Ill. 60618

[21] Appl. No.: 143,315

[22] Filed: Apr. 24, 1980

[51] Int. Cl.[3] ..... B26B 19/00; A45D 20/00

[52] U.S. Cl. ..... 30/133; 34/97; 132/9

[58] Field of Search ..... 30/133, 41.6; 132/118, 132/9; 34/97

[56] References Cited

U.S. PATENT DOCUMENTS

| | | | |
|---|---|---|---|
| 1,238,061 | 8/1917 | Bourdelat | 30/133 |
| 2,753,434 | 7/1956 | Storm | 34/97 X |
| 4,097,722 | 6/1978 | Soler | 132/9 X |
| 4,150,483 | 4/1979 | Kanazawa | 30/133 |
| 4,198,556 | 4/1980 | Crowley | 132/9 X |
| 4,210,162 | 7/1980 | Dreyer | 132/9 |
| 4,219,931 | 9/1980 | Vacilotto | 30/133 |

FOREIGN PATENT DOCUMENTS

| | | | |
|---|---|---|---|
| 52-9546 | 1/1977 | Japan | 30/133 |

*Primary Examiner*—Jimmy C. Peters

*Attorney, Agent, or Firm*—Robert E. Browne; Ralph R. Rath

[57] ABSTRACT

A hair cutting device includes a housing defining a passage having an inlet and outlet with a cutter and an impeller between said inlet and outlet. A hair directing apparatus is positioned between the cutter means and the impeller to direct the hair to the periphery of the cutter and the inlet is adjustable with respect to the inlet. The cutter includes two blades one of which is rotated with an output motor shaft and the other is reciprocated on the output shaft. The drive motor is reversible and a heating element can be attached to the outlet to convert the device to a blower-dryer.

17 Claims, 9 Drawing Figures

HAIR CUTTING DEVICE

TECHNICAL FIELD

The present invention relates generally to hair clippers and more specifically to a hair cutting device wherein the length of the hair cut is automatically controlled.

BACKGROUND PRIOR ART

Numerous proposals have been made for hair cutting apparatus which can be used for cutting, trimming or styling hair of substantial length. For example, U.S. Pat. No. 4,150,483 discloses a hair cutting apparatus wherein a suction is created in a housing and a cutting apparatus is located in the suction path so that the hair is clipped and then accumulated in a suitable casing connected to the opposite end of the package. Another device for trimming hair is disclosed in U.S. Pat. No. 3,900,949, which also discloses a hair cutting apparatus having a vacuum associated therewith to draw the hair into the cutter and also an adjusting mechanism for automatically cutting the hair at a predetermined length.

While numerous such devices have been proposed, none to date have found any degree of commercial success. Therefore, the conventional comb and scissors and mechanical or electrical clippers are still utilized as the basic hair cutting device which requires a significant degree of skill in the technique of use. There, therefore, remains a need for an acceptable apparatus that can be utilized by an unskilled person without any significant degree of experience and one which will cut the hair at predetermined lengths with a certain degree of accuracy.

SUMMARY OF THE INVENTION

According to the primary aspect of the present invention, a hair cutting apparatus or device consists of a housing that defines an elongated suction passage that has an inlet at one end and an outlet at the opposite end with blade means between the inlet and the outlet. An electric motor which imparts a cutting action to a pair of blades supported thereon and defining the blade means and also drives an impeller which creates the air flow between the inlet and the outlet. The blade means consists of first and second cooperating cutting blades that have peripheral cutting edges and are supported on the output shaft for the motor. One of the blades is secured to the output shaft for rotation therewith while the other of the blades is supported for rotation thereon and means are provided between the shaft and the other cutting blade for producing reciprocating motion between the blades during rotation thereof.

According to one of the principal aspects of the present invention, the hair cutting device has a hair directing means between the inlet and the cutter blades which directs the hair to the peripheral cutting edges of the blades to insure a uniform length of cut of the hair. In the specific embodiment illustrated, the hair directing means is in the form of a conical element that is aligned with the output shaft and the cutter blade rotated therewith to direct the hair that is being sucked into the passage to the periphery of the cutting blades and insure an accurate length of cut.

The specific drive means for imparting oscillatory motion to one of the cutting blades includes a gear rotated with the shaft and in mesh with an idler gear that has an eccentric drive member supported thereon which is received into an elongated radial slot so that rotation of the gears will produce an oscillatory motion to the driven cutting blade.

According to a further aspect of the present invention, the electric motor which drives the cutting blades and the impeller is reversible so as to reverse the air flow within the passage and a heating element is adapted to be attached to the outlet end of the passage so that the hair cutting device can be converted to a blower-dryer.

BRIEF DESCRIPTION OF SEVERAL VIEWS OF DRAWINGS

DETAILED DESCRIPTION

Figures 1, 2, 9:
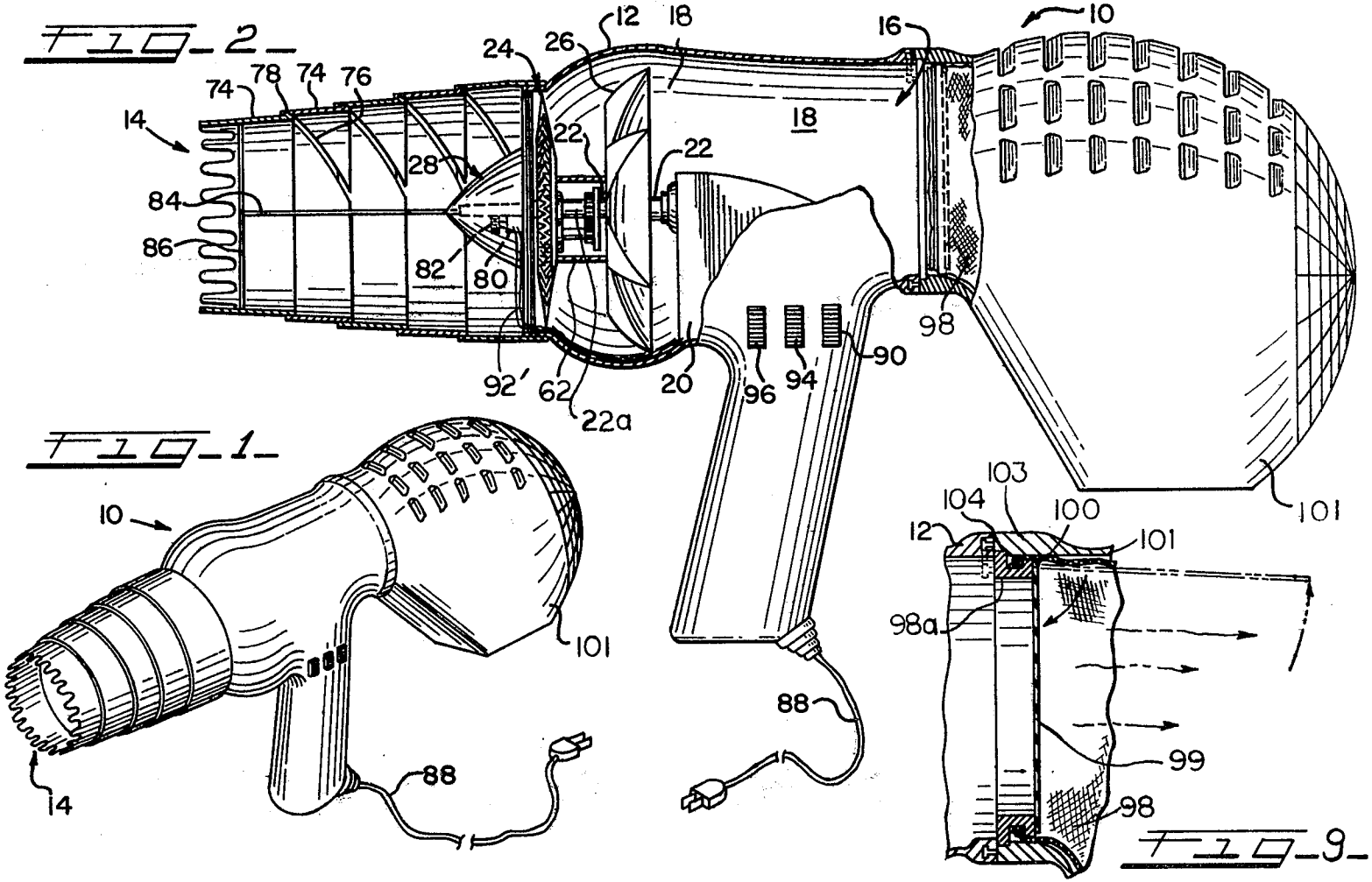
FIG. 1 is a perspective view of the hair cutting device constructed in accordance with the teachings of the present invention.
FIG. 2 is an enlarged fragmentary side elevation view of the device shown in FIG. 1.
FIG. 9 is a fragmentary sectional view of the hair collector.

While this invention is susceptible of embodiment in many different forms, there is shown in the drawing and will herein be described in detail preferred embodiments of the invention with the understanding that the present disclosure to be considered as an exemplification of the principles of the invention and is not intended to limit the invention to the embodiments illustrated.

FIGS. 1 and 2 of the drawings show a hair cutting device generally designated by reference numeral 10 including a housing 12 having an inlet opening 14 and an outlet opening 16 at opposite ends of a passage 18. An electric motor or drive means 20 is located within passage 18 and has an output drive shaft 22 that is generally aligned with the central axis of the generally cylindrical passage 18. The output shaft or the drive means has blade means 24 and an impeller means 26 supported thereon and a hair directing means 28 aligned therewith.

Figure 3:
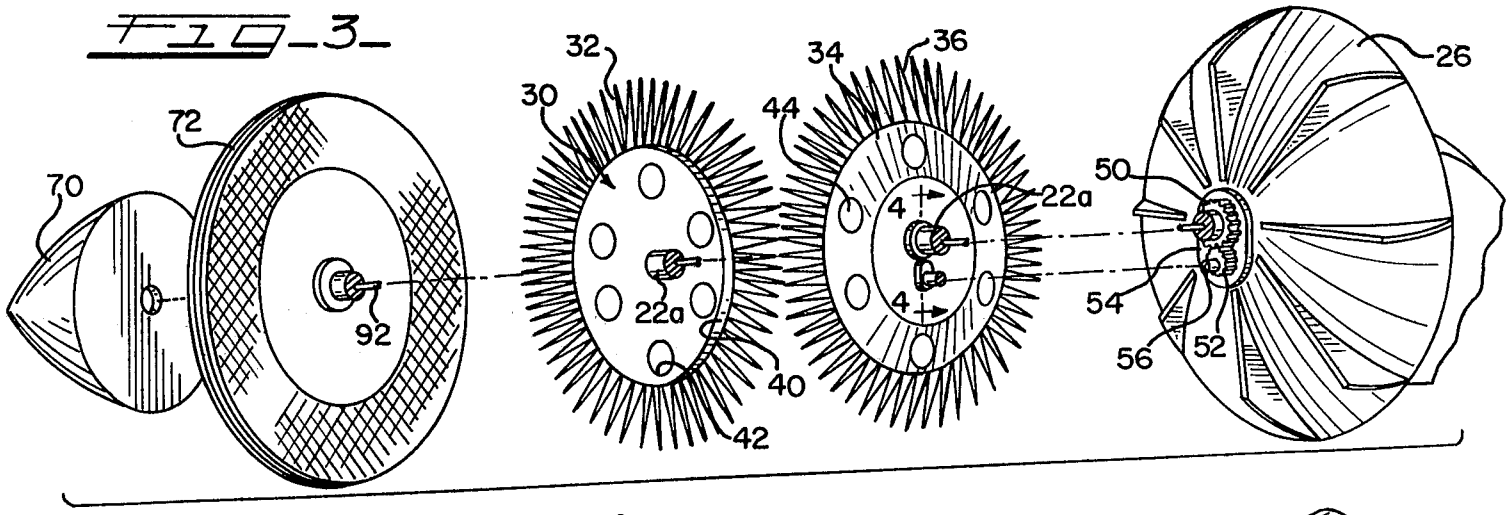
FIG. 3 is an exploded perspective view of the various components of the hair cutting device.
Figure 6:
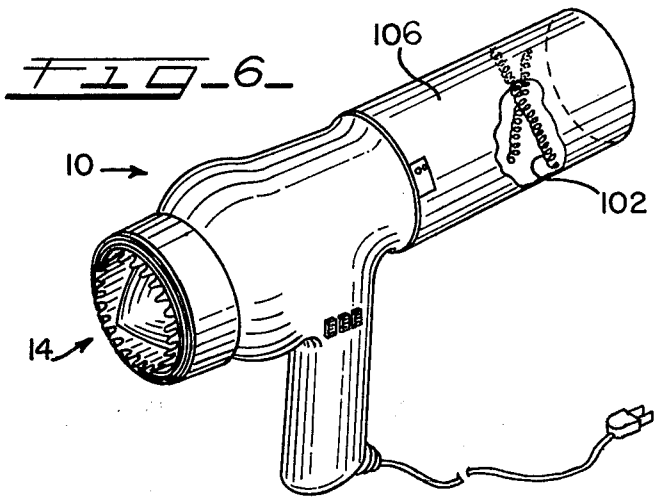
FIG. 6 is a view similar to FIG. 1 showing the hair cutting device converted to a blower-dryer.

As illustrated in FIG. 3, the blade means 24 includes a first cutting blade 30 that is fixedly secured to a stationary shaft extension 22*a*, extending from impeller 26, and has a peripheral cutting edge 32 on the circular outer edge thereof. Likewise, a second cutting blade 34 has a peripheral cutting edge 36 and is supported for rotation relative to shaft extension 22*a*. The respective cutting blades are normally biased towards each other through suitable biasing means (not shown) so as to be in frictional engagement with each other.

In order to reduce the amount of friction between the two members, blade 30 preferably has a center recess portion 40 and to reduce the weight thereof, the center portion of blade 30 has a plurality of holes 42 formed therein. Likewise, blade 34 has a plurality of openings 44 for reducing the weight thereof and may also have a center recess portion similar to recess portion 40, if desired. Also, the diameter of the center core portion is preferably one-half the diameter of the peripheral edges of the cutting blades.

Figure 4:
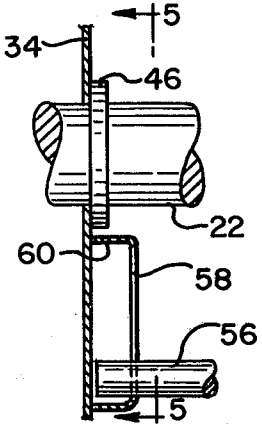
FIG. 4 is an enlarged fragmentary sectional view, as viewed along lines 4—4 of FIG. 3.
Figure 5:
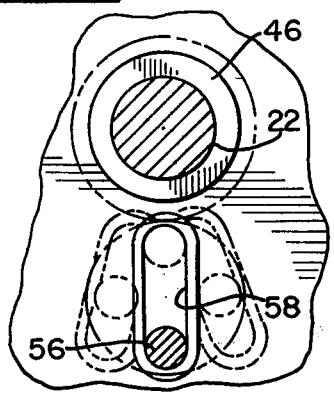
FIG. 5 is a view of the components as viewed along line 5—5 of FIG. 4.

Blade 30 is fixedly secured to output shaft extension 22*a* while blade 34 is rotatably supported thereon and is retained adjacent to blade 30 through a suitable collar 46 (FIG. 4) which is secured to the shaft extension 22*a*. Blade 34 is oscillated or reciprocated about shaft extension 22*a* through a drive gear 50 that is fixed to shaft 22*a* and is in constant mesh with a driven gear 52 that is carried by a support 54 and has an eccentric drive member 56 extending therefrom. Shaft extension 22*a* is held by bearings or suitable means (not shown) within gear 50 so that it does not rotate. Drive member 56 has an opposite free end received into an elgonated slot 58 defined in a cage 60 that is secured to an adjacent surface of blade 34. Support 54 is suspended from shaft extension 22*a* and the weight of support 54, gear 52 and eccentric member 56 will maintain the components in a substantially stationary position while shaft 22 is rotated and extension 22*a* remains stationary. If desired, suitable brackets or braces (not shown) may extend from housing 12 to maintain support 54 in a fixed position within passage 18. Thus, during rotation of shaft 22, blade 30 will remain fixed while blade 34 will be oscillated or reciprocated between predetermined extreme positions by rotation of the eccentric member 56 which will be moved along slot 58 to produce the oscillatory motion illustrated in FIG. 5. This unique drive mechanism for the blade will insure a precise and clean cut of the hair being directed toward the peripheral cutting edges 32 and 36, as will be explained later. In order to prevent hair from becoming entangled with the gears, it is desirable to have a cover 62 telescoped over and covering gears 50 and 52.

According to one aspect of the invention, the hair directing means 28 is positioned between the cutting blades or cutting means 24 and the inlet end 14 of the housing 12. As illustrated in FIG. 3, the hair direction means includes a substantially conical element 70 which is secured to the center of an aperatured baffle or filter 72, which has its periphery attached to housing 12. The conical element 70 is preferably a hollow member that directs the hair which is received through inlet opening 14 and filter 72 to the peripheral cutting edges 32 and 36 of cutting blades 30 and 34. Also, the filter 72 will insure that the hair is received in an axial alignment with the shaft 22 and extension 22*a* so that a precise cut is made on the hair. The maximum diameter of the conical element 70 is preferably equal to the diameter of the core portion of cutting blade 32 so that all of the cutting area of the blades is exposed.

According to one aspect of the invention, the inlet end portion of housing 12 is designed to be adjustable to vary the spacing between inlet 14 and cutting means 24. As illustrated in FIG. 2, the housing 12 has a plurality of telescoping sections 74 located between inlet opening 14 and blade means 24. The respective telescoping sections 74 each have a spiral guide slot 76 with each of the adjacent sections having a pin 78 received into a slot 76 on the next section. Extension and retraction of sections 74 is preferably produced by a small reversible motor 80 supported on filter 72 within conical member 70. Motor 80 has a gear 82 cooperating with a telescoping antenna-like member 84. The outer end of member 82 is attached to outermost section 74 by a bridge member 86.

Electric power is supplied to motor 80 from a cord 88 through a switch 90 and wires 92' (FIG. 2) extending through shaft 22 and shaft extension 22*a*. Alternatively, these wires may be extended through the housing as shown at 92' in FIG. 2. Thus, energizing motor 80 in one direction will extend sections 74 and in the other direction will retract them. Cord 88 also supplied power through switch 94 to motor 20 and to a further switch 96, the purpose of which will be described later.

A bag 98 is preferably releasably attached to the outlet end 16 of passage 18 through a collar 98*a*, as will be explained. According to one aspect of the invention, the outlet end 18 is closed when the motor is not energized to prevent the cut hair from getting into passage 18, as shown in FIG. 9, a flapper valve 99 is pivoted through a hinge 100 on the upper end of collar 98*a* and is movable from a closed position to an open position in response to air flow through outlet end. Thus the flapper valve automatically closes when motor 20 is deenergized. If desired, flapper valve may be biased to a closed position with a spring incorporated into hinge 100. The porous bag 98 is preferably received into an apertured cover 101 which has a sleeve portion 103 at one end that receives the bag and is releasably retained on housing 12 through a releasable connection, such as a pin and bayonet slot (not shown). Cover has a shoulder 104 which is engaged by collar 98*a* so that the collar is clamped between housing 12 and shoulder 104 when cover 101 is attached to housing 12.

In operation, switch 94 is actuated after the plug of cord 88 is inserted in a suitable electric outlet to produce rotation of shaft 22. Rotation of shaft 22 will rotate impeller 26 to create an air flow between inlet 14 and outlet 16, as indicated by the arrows A in FIG. 2, and will move flapper valve 99 to an open position. Thus, a suction or a negative pressure will be created at inlet 14 which will suck the hair into the inlet towards the conical element or hair directing means 28. The hair directing means will direct the hair to the periphery of passage 18 through filter 72 into the path of cutting blades 30 and 34 where the hair is severed at a predetermined length, defined by the position of the inlet with respect to the cutter means 24. The severed portions of the hair are directed through the passage 18 and are collected in bag 98. When the power is interrupted, flapper valve will close to retain the severed hair in the bag.

If the length of the cut is to be changed, it is only necessary to actuate motor 80 through switch 90 and rotate the output shaft with gear 82 thereon in the appropriate direction to extend or retract the expansible sections 74.

According to one aspect of the present invention, the hair cutting device is also readily adapted to be converted to a blower-dryer. To convert the device to a blower-dryer, it is only necessary to remove the accumulator unit or bag 98 and insert a detachable unit 106 that includes a heating element 102. The heating element is attached to switch 96 to be energized from cord 88 when switch 96 is actuated. When the unit is used as a blower-dryer, the rotation of output shaft 22 is reversed and the impeller 26 will then draw air in the opposite direction and force it through inlet opening 14.

Figure 7:
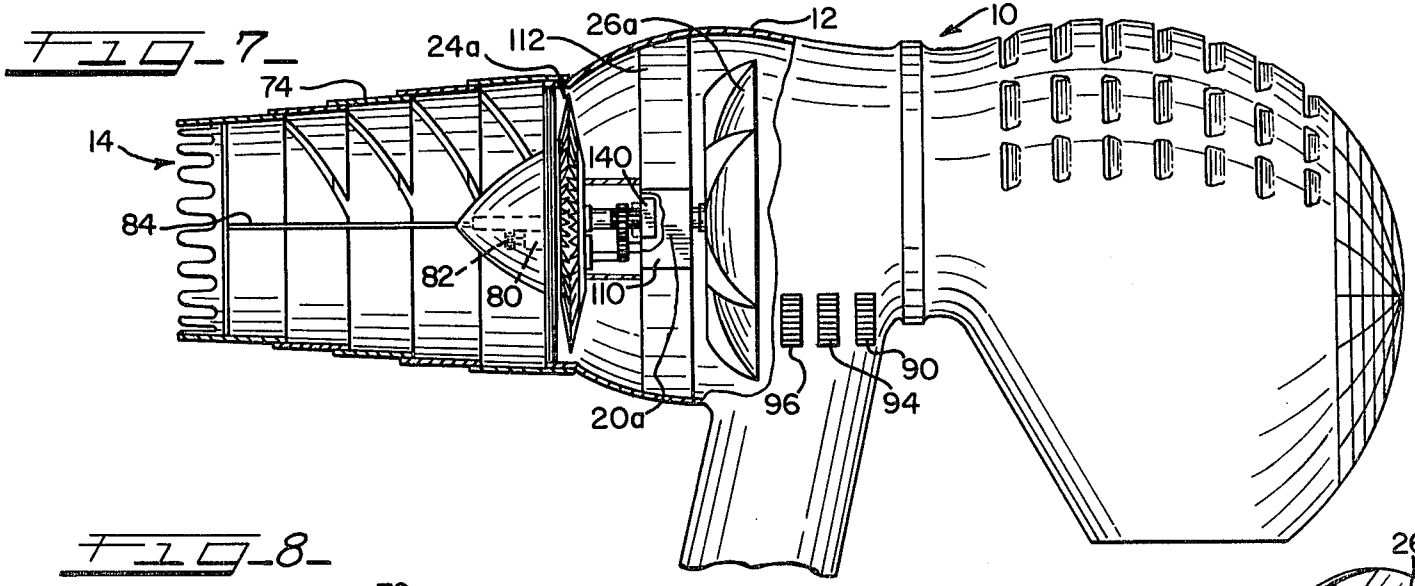
FIG. 7 is a view similar to FIG. 1 showing a slightly modified form of the invention.
Figure 8:
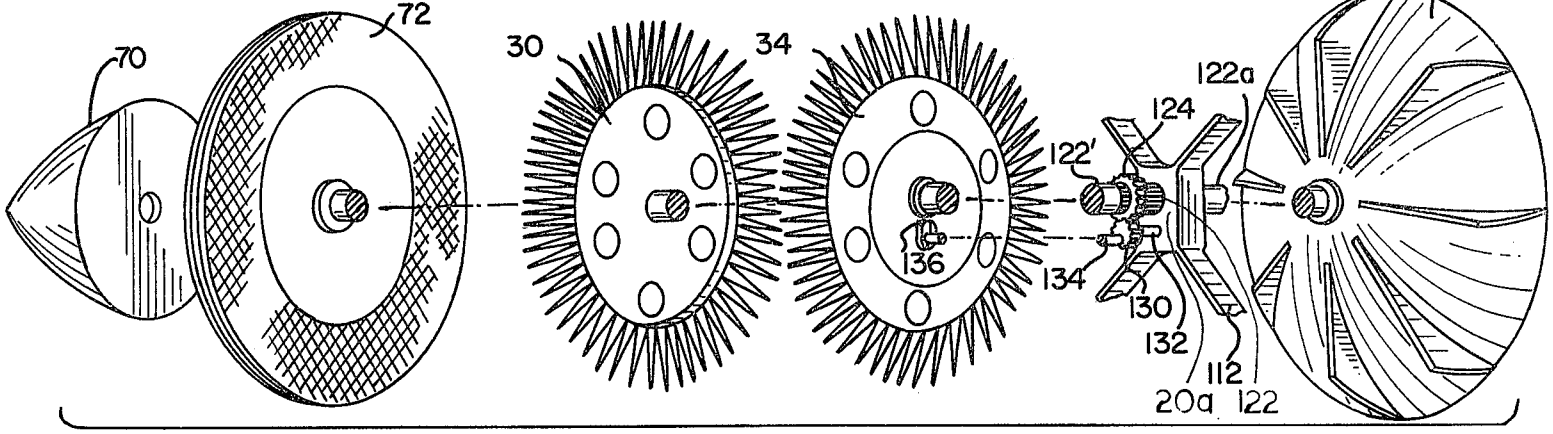
FIG. 8 is an exploded view of the components of the embodiment shown in FIG. 7.

A slightly modified version of the invention is disclosed in FIGS. 7 and 8, and is in many respects similar to the embodiment illustrated in FIGS. 1 through 6. Thus, the same reference numerals have been utilized in the embodiment illustrated in FIGS. 7 and 8, and the distinctions are in the arrangement of the components, particularly, motor 20*a*, impeller 26*a* and the drive mechanism for cutting means 24*a*.

In the embodiment illustrated in FIGS. 7 and 8, motor 20*a* has an output shaft 122 which extends from opposite ends of the motor housing 112. Impeller 26*a* is attached to the rear end 122*a* of shaft 122 and is located rearwardly of the motor housing 112 as shown in FIG. 7. The opposite end of output shaft 122 has a gear 124 which is supported for axial movement on the shaft and for rotation therewith. For this purpose, the shaft 122 can be splined and the gear supported on the splined portion of the shaft for axial movement thereon. A shaft extension 122' is again journaled by suitable means to shaft 122 so that it is supported thereby but does not rotate therewith. Drive gear 124 is in mesh with a driven gear 130 which is supported on a shaft 132 that is rotatably supported on the motor housing of motor 20*a*. An eccentric member 134 extends from gear 130 and has its free end received in elongated slot 136 defined in cutting blade 34*a*. Gear 124 is normally biased to the position illustrated in FIGS. 7 and 8 to be in mesh with gear 130 through a spring (not shown).

Motor housing 110 has a magnet 140 (FIG. 7) supported in alignment and surrounding output shaft 122 adjacent the wall which has the gear 124 associated therewith. Magnet 140 is connected to switch 96 to be energized when the switch is in an on position and when the heating element (shown in FIG. 6) is attached to the hair cutting device. Thus, when magnet 140 become energized, it will draw the gear 124 towards motor housing 110 to disengage the drive gear from the driven gear 130. Thus, when the hair cutting device is utilized as a blower-dryer, the cutting blades remain stationary to reduce the power requirements for the motor and to also decrease the amount of wear experienced by the cutting means.

The embodiment illustrated in FIGS. 7 and 8, is in all other respects identical to the embodiment described in connection with FIGS. 1 through 6.

I claim:

1. A suction type hair cutting device comprising a housing defining a passage having an inlet and an outlet, blade means between said inlet and said outlet with drive means imparting a cutting action to said blade means and an impellor driven by said drive means producing a suction at said inlet, and a conical element rotatable with said blade means for directing hair to the periphery of said passage for said cutting action.

2. A hair cutting device as defined in claim 1 in which said drive means includes a motor having an output shaft and said blade means includes first and second circular blades mounted along an axis of said output shaft and having cutting edges on the periphery thereof, and means between said output shaft and said blades for moving said blades in reciprocal cutting fashion relative to each other.

3. A hair cutting device as defined in claim 1 in which said blade means includes first and second substantially circular blades and said passage is substantially circular and in which said drive means includes a motor having a rotatable output shaft generally aligned with a center of said passage and having said impeller rotated therewith, a shaft extension extending from said impeller and aligned with said output shaft, said first blade being secured to said shaft extension, said second blade being rotatable on said shaft extension between said first blade and said impeller means between said shaft extension and said second blade producing oscillary motion to said second blade while said first blade remains stationary with said shaft extension.

4. A hair cutting device as defined in claim 3, in which said last means includes a drive gear on said shaft extension and rotating therewith, a substantially stationary support depending from said shaft with a driven gear rotatably supported on said support and in mesh with said drive gear, said driven gear having an eccentric drive member and said second blade having a radially extending slot receiving said eccentric drive member to oscillate said second blade in response to rotation of said driven gear.

5. A hair cutting device as defined in claim 1, in which said drive means includes a motor having an output shaft extending from opposite ends thereof generally axially of said passage with said impeller secured to one end of said shaft, and said blade means includes first and second blades having peripheral cutting edges with said first blade secured to the opposite end of said shaft and said second blade frictionally engaging said first blade and rotatably supported on said output shaft, and means for imparting oscillatory motion to said second blade while said first blade is fixed to said output shaft.

6. A hair cutting device as defined in claim 5, in which said last means includes a drive gear rotatable with and axially movable on said shaft, a second gear rotatably supported on said motor adjacent said output shaft and in mesh with said drive gear, said second blade having a generally radially extending slot and said second gear having an eccentric drive member received in said slot to oscillate said second blade in response to rotation of said second gear, and means for moving said drive gear axially on said shaft to disengage said gears.

7. A hair cutting device as defined in claim 1, in which said drive means is reversible to produce air flow through said inlet and further including a heating element attachable to an opposite end of said passage to convert said suction device to a heatedblower device.

8. A hair cutting device comprising a housing having a passage with an inlet end, a motor in said passage having a driven output shaft, first and second cooperating cutting blades having peripheral cutting edges rotatable with said shaft, said first blade being secured to said shaft and said second blade being mounted for relative rotation on said shaft and means between said shaft and second blades for producing reciprocating motion between said blades during rotation thereof.

9. A hair cutting device as defined in claim 8, further including an impeller rotatable with said output shaft for producing air flow from said inlet through said passage.

10. A hair cutting device as defined in claim 9, in which said motor is reversible to reverse the direction of air flow in said passage and a heating element coupleable to an opposite of said passage to convert said cutting device to a blower-dryer.

11. A hair cutting device as defined in claim 8, in which said means between said output shaft and said second blade includes a drive gear rotatable with said shaft and in constant mesh with a driven gear and support means adjacent said shaft for rotatably supporting said driven gear, said driven gear having an eccentric output with said one of said blades having an elongated slot receiving said eccentric output so that rotation of said driven gear will oscillate said one of said blades on said output shaft relative to said other blade.

12. A hair cutting device as defined in claim 11, in which said drive gear is axially movable on said output shaft and means for axially moving said drive gear to disengage said gears.

13. A hair cutting device as defined in claim 12, in which said motor is reversible to reverse the direction of air flow and further including a heating element attachable to an opposite end of said passage to convert said device to a blower-dryer.

14. A hair cutting device as defined in claim 8, further including adjustment means between said blade means and said inlet for varying the length of hair cut.

15. A hair cutting device as defined in claim 14, in which said adjustment means includes a plurality of telescoping sections with reversible power means for telescoping said sections.

16. A hair cutting device comprising a housing having a substantially circular passage with an inlet end, a motor in said passage having a driven output shaft, first and second substantially circular cooperating cutting blades having peripheral cutting edges rotatable with said shaft, means between said shaft and one of said cutting blades for producing reciprocating motion between said blades during rotation thereof, and a cone connected to and rotatable with said shaft for directing hair to the periphery of said blades.

17. A hair cutting device comprising a housing having a passage with an inlet end and an outlet end, a motor in said passage having a driven output shaft, first and second cooperating cutting blades having peripheral cutting edges rotatable with said shaft, means between said shaft and one of said cutting blades for producing reciprocating motion between said blades during rotation thereof, an impeller rotatable with said output shaft, collector means on said outlet end, and valve means adjacent said outlet end opened in response to air flow in said passage and closed with said air flow is interrupted.

* * * * *